US008276772B2

(12) United States Patent
Kim

(10) Patent No.: US 8,276,772 B2
(45) Date of Patent: Oct. 2, 2012

(54) SHELF FOR SHOWCASE

(75) Inventor: Deok Rae Kim, Goyang-si (KR)

(73) Assignee: Seidai Industrial Co., Ltd., Goyang-si (KR)

( * ) Notice: Subject to any disclaimer, the term of this patent is extended or adjusted under 35 U.S.C. 154(b) by 299 days.

(21) Appl. No.: 12/593,961

(22) PCT Filed: Feb. 28, 2008

(86) PCT No.: PCT/KR2008/001166

§ 371 (c)(1),
(2), (4) Date: Sep. 30, 2009

(87) PCT Pub. No.: WO2009/075409

PCT Pub. Date: Jun. 18, 2009

(65) Prior Publication Data

US 2010/0072152 A1 Mar. 25, 2010

(30) Foreign Application Priority Data

Dec. 12, 2007 (KR) ..... 10-2007-0128692

(51) Int. Cl.
*A47F 5/08* (2006.01)

(52) U.S. Cl. ..... 211/151

(58) Field of Classification Search ..... 211/151, 211/162, 59.2, 59.3; 312/42, 45, 71; 198/861.1, 198/35 R, 35 J, 35 C; 414/276
See application file for complete search history.

(56) References Cited

U.S. PATENT DOCUMENTS

| | | | | | |
|---|---|---|---|---|---|
| 2,593,089 | A | * | 4/1952 | Barry | 193/35 R |
| 3,220,527 | A | * | 11/1965 | Curtis | 193/35 R |
| 3,480,126 | A | * | 11/1969 | Jung | 193/35 A |
| 3,586,142 | A | * | 6/1971 | Inwood et al. | 193/35 R |
| 3,900,112 | A | * | 8/1975 | Azzi et al. | 211/187 |
| 3,954,170 | A | * | 5/1976 | Schlough | 193/35 R |
| 4,785,945 | A | | 11/1988 | Rowse et al. | |
| 5,048,661 | A | * | 9/1991 | Toye | 193/35 R |
| 5,115,920 | A | * | 5/1992 | Tipton et al. | 211/59.2 |
| 5,259,518 | A | * | 11/1993 | Sorenson et al. | 211/59.2 |
| 5,295,591 | A | * | 3/1994 | Slater | 211/59.2 |
| 5,474,412 | A | * | 12/1995 | Pfeiffer et al. | 414/276 |
| 5,645,155 | A | * | 7/1997 | Houghton | 193/35 R |
| 5,788,090 | A | * | 8/1998 | Kajiwara | 211/59.2 |
| 5,951,228 | A | * | 9/1999 | Pfeiffer et al. | 414/276 |

(Continued)

FOREIGN PATENT DOCUMENTS

JP 2000-316680 A 11/2000

(Continued)

*Primary Examiner* — Jennifer E. Novosad
(74) *Attorney, Agent, or Firm* — Kirton McConkie; Evan R. Witt

(57) ABSTRACT

A shelf for a showcase in which a roller unit is formed with holding grooves on both sides of a bottom surface of a U-shaped roller plate. Fixing frames coupled with the roller plate include a bottom part, formed with a vertical rib to be fitted into the holding groove of the roller plate, and a vertical wall surrounding an outside of the roller plate and formed with a horizontal rib closing opened parts of fitting grooves of the roller plate, so that the fixing frames are mounted on both sides of the roller plate of the roller unit in pair correspondingly to each other. The vertical walls are formed with screw-coupling holes at front and rear ends in accordance with screw holes punched at both side walls of the end caps so as to be integrally coupled together by coupling screws.

6 Claims, 5 Drawing Sheets

U.S. PATENT DOCUMENTS

| | | | | |
|---|---|---|---|---|
| 6,089,385 | A * | 7/2000 | Nozawa | 211/59.2 |
| 6,132,158 | A * | 10/2000 | Pfeiffer et al. | 414/276 |
| 6,186,725 | B1 * | 2/2001 | Konstant | 414/276 |
| 6,409,026 | B2 * | 6/2002 | Watanabe | 211/59.2 |
| 6,431,808 | B1 * | 8/2002 | Lowrey et al. | 414/276 |
| 6,490,983 | B1 * | 12/2002 | Nicholson et al. | 108/106 |
| 6,497,326 | B1 * | 12/2002 | Osawa | 211/59.2 |
| 6,523,664 | B2 * | 2/2003 | Shaw et al. | 193/35 R |
| RE38,517 | E * | 5/2004 | Pfeiffer et al. | 414/276 |
| 6,830,146 | B1 * | 12/2004 | Scully et al. | 198/836.1 |
| 6,948,900 | B1 * | 9/2005 | Neuman | 414/267 |
| 7,007,790 | B2 * | 3/2006 | Brannon | 198/346 |
| 7,114,606 | B2 * | 10/2006 | Shaw et al. | 193/35 R |
| 7,815,060 | B2 * | 10/2010 | Iellimo | 211/151 |
| 8,025,162 | B2 * | 9/2011 | Hardy | 211/59.3 |
| 2001/0017284 | A1 * | 8/2001 | Watanabe | 211/59.2 |
| 2004/0178156 | A1 * | 9/2004 | Knorring et al. | 211/59.2 |
| 2010/0078402 | A1 * | 4/2010 | Davis et al. | 211/184 |
| 2010/0206829 | A1 * | 8/2010 | Clements et al. | 211/162 |
| 2011/0215060 | A1 * | 9/2011 | Niederhuefner | 211/59.3 |

FOREIGN PATENT DOCUMENTS

| | | |
|---|---|---|
| KR | 20-0292985 Y1 | 10/2002 |

* cited by examiner

SHELF FOR SHOWCASE

TECHNICAL FIELD

The present invention relates to a shelf for a showcase, and more particularly to a shelf for a showcase which is improved in the structure of fixing frames and connection frames for receiving roller units having a plurality of rollers and coupling end caps at front and rear ends.

BACKGROUND ART

In general, a shelf for a showcase, which is placed in convenience stores and the like, is to display goods at a front end thereof for a purchaser to distinguish and select the goods conveniently. As the purchaser takes one of the goods from the front end of the shelf, a next one positioned behind the taken one becomes moved to the front end by sliding due to a down-slope from a rear end toward the front end of the shelf which is slant by an inclination angle. The shelf is mounted with a plurality of rollers on a bottom surface contacting the goods for the movement of the next good toward an empty space previously occupied by the first good which is taken by the purchaser, and guide elements for defining spaces for displaying the goods as being aligned in lines.

Korean Utility Model Reg. Pub. No. 20-0327237 of the present inventor discloses a shelf for a showcase including a plurality of rollers for first-in and first-out of displayed goods, as shown in FIG. 11 to FIG. 15.

Referring to FIG. 11 and FIG. 13 respectively showing an exploded perspective view and a cross-sectional view of an improved shelf 1 for a showcase having in a plurality of rollers 3 coupled for sliding movement of goods secured on the shelf, includes a roller unit 2 formed of a U-shaped roller plate 23 having a plurality of fitting grooves 22 at both side walls 21 to rotatably insert mounting shafts 31 protruded at both side ends of rollers 3, a casing 4 having both side walls 41 respectively formed with a rib 42 for closing opening parts of the fitting grooves 22 of the roller plate 23 to prevent deviation of the rollers 3 after the rollers 3 are fitted into the roller unit 2, and a bottom surface 43 connecting the side walls to each other and formed with chilled air ventilation holes 44, end caps 5 coupled with front and rear ends of the casing 4, and guide elements 9 formed with metal or synthetic resin materials and fitted into insertion grooves 51 of the end caps 5 at both ends to serve as barriers.

The prior art shelf for a showcase has, however, problems not only in machining, assembling and continuous connection of such roller units but also in the structure causing high expenses relating to raw materials and machining. In the shelf 1, each of the component parts is formed with aluminum metal or synthetic resin materials by injection molding, extrusion, die-casting, pressing and the like. The roller unit 2 includes the roller plate 23, which is injection-molded to have the fitting grooves 22 at the side walls for mounting the mounting shafts 31 of the plurality of rollers 3 and the plurality of chilled air ventilation holes 24 in the horizontal bottom surface by a uniform interval. This roller unit 2 is publicly-known in the art and widely used due to the convenience in the mounting of the plurality of rollers 3. The casing 4, which prevents deviation of the rollers 3 and promotes smooth sliding of goods by fitting the rollers in the roller unit 2, is formed with aluminum materials having high durability by extrusion to bear loads of the roller unit 2 and displayed goods. The end caps 5 screw-coupled with the front and rear ends of the casing 4 are injection molded. The guide elements 9 are formed with synthetic resin materials by injection molding or a metal plate by pressing.

The casing 4, one of the component parts of the prior art shelf 1 for a showcase, is formed by continuous extrusion in the lengthwise direction and cut by a predetermined length.

The casing 4 is formed with chilled air ventilation holes 44 in a bottom surface 43 correspondingly to the chilled air ventilation holes 24 of the roller plate 23 of the roller unit 2 by pressing so as to promote smooth circulation of chilled air. The casing 4 is formed with holes 45 at the front and rear ends by punching to insert coupling screws 8 for fixing the end caps.

The prior art shelf 1 for a showcase has a disadvantage in the expense since the casing 4 is extruded as a single element incurring high raw material expense and pressed to form the chilled air ventilation holes 44 incurring additional expenses for machining and finishing of the chilled air ventilation holes 44.

Further, if the casing 4 has a central wall 46 formed with a rib 47 at an upper end thereof to align the roller units 2 in two lines in the casing 4 for the smooth sliding of relatively large-volumed goods on the roller units 2, as shown in the cross-sectional view of FIG. 14, the above expenses for the raw materials and the pressing and finishing of the chilled air ventilation holes 44 may be increased by double or more. Furthermore, in order to increase the alignment lines of the roller units 2 to 3 to 6 lines to provide a wide sliding area for frequent adjusting of display intervals of goods or for the display of the large-volumed goods, as shown in FIG. 15, the size of the casing 4 mounted with the central walls 46 and the ribs 47 by a uniform interval has to be increased according to the quantity of the roller units 2. In addition, it is difficult to keep smoothness during the extrusion of the casing 4 in the increased size, so that the casing 4 is apt to be distorted. It is impossible to assemble such the defect casing 4 due to the defect in the extrusion. Therefore, the casing 4 is disadvantageously limited in the small size to align the roller units 2 only in a single line or two lines.

DISCLOSURE OF INVENTION

Technical Problem

Therefore, the present invention is derived to resolve the above and any other disadvantages of the prior art, and an object of the invention is to provide a shelf for a showcase improved in the structure, in which a prior art casing is separated into a fixing frame and a connection frame so as to simplify the use of a single roller unit having a plurality of rollers or the connection of a plurality of such the roller units, reduce the expenses in moldings and raw materials, and minimize machining and assembling steps in order to improve productivity, while keeping smooth sliding movement of goods.

Technical Solution

In order to achieve the above object, according to the present invention, there is provided a shelf for a showcase including a roller unit formed of a U-shaped roller plate having both side walls formed with a plurality of fitting grooves to be rotatably inserted by mounting shafts which are protruded at both side ends of rollers, fixing frames coupled with the roller plate by closing opening parts of the fitting grooves for preventing deviation of the rollers after the rollers are fitted into the roller unit, end caps coupled at front and rear ends of the fixing frames, and a guide element having both ends inserted into insertion grooves of the end caps to serve as a barrier, which is characterized in that the roller unit is formed with holding grooves on both sides of a bottom surface of the roller plate, and each of the fixing frames includes a bottom part formed with a vertical rib to be fitted into the holding grooves of the roller plate, and a vertical wall surrounding an outside of the roller plate and formed with a horizontal rib closing opened parts of the fitting grooves of the roller plate so that the fixing frames are mounted on both sides of the roller plate of the roller unit in pair correspondingly to each other, wherein the vertical wall is formed with screw-coupling holes at front and rear ends in accordance with screw holes formed at both side walls of the end caps so as to be integrally coupled together by coupling screws.

In order to achieve the above object of the present invention, in the shelf for a showcase according to the present invention, the vertical wall of any one of the fixing frames is formed with holding protrusions formed outward in upper and lower parts thereof, and the vertical wall of an adjacent fixing frame is provided with fitting protrusions to be fitted with the holding protrusions, so that the holding protrusions and the fitting protrusions are coupled with each other in a horizontal condition.

In order to achieve the above object of the present invention, in the shelf for a showcase according to the present invention, a connection frame has vertical ribs to be fitted into the holding grooves of first and second roller plates and a horizontal rib for closing opening parts of the fitting grooves of the first and second roller plates, and is fitted into the end caps, so as to align two to six roller units in connection.

In order to achieve the above object of the present invention, in the shelf for a showcase according to the present invention, one roller unit may be used alone or two, three, or six roller units are connected to each other as a single unit depending on the use of the fixing frames alone or in addition with the connection frames, wherein the end caps are separately formed for simplifying the mounting thereof to the front and rear ends.

Advantageous Effects

According to the present invention, a single roller unit having a plurality of rollers or a plurality of such the roller units may be simply mounted in the horizontal state by using the connection frames in addition to the fixing frames in the improved structure for surrounding both sides of the single roller unit or the connected plurality of roller units, so that the structure may be simplified, minimizing the expenses in the moldings and the raw materials. Further, machining or finishing work for chilled air ventilation holes is not necessary any more, so that the productivity may be improved and the manufacturing cost thereof may be reduced advantageously.

BRIEF DESCRIPTION OF THE DRAWINGS

The objects, features and advantages of the present invention will be more clearly understood from the following detailed description in conjunction with the accompanying drawing, in which.

BEST MODE FOR CARRYING OUT THE INVENTION

Figure 11:
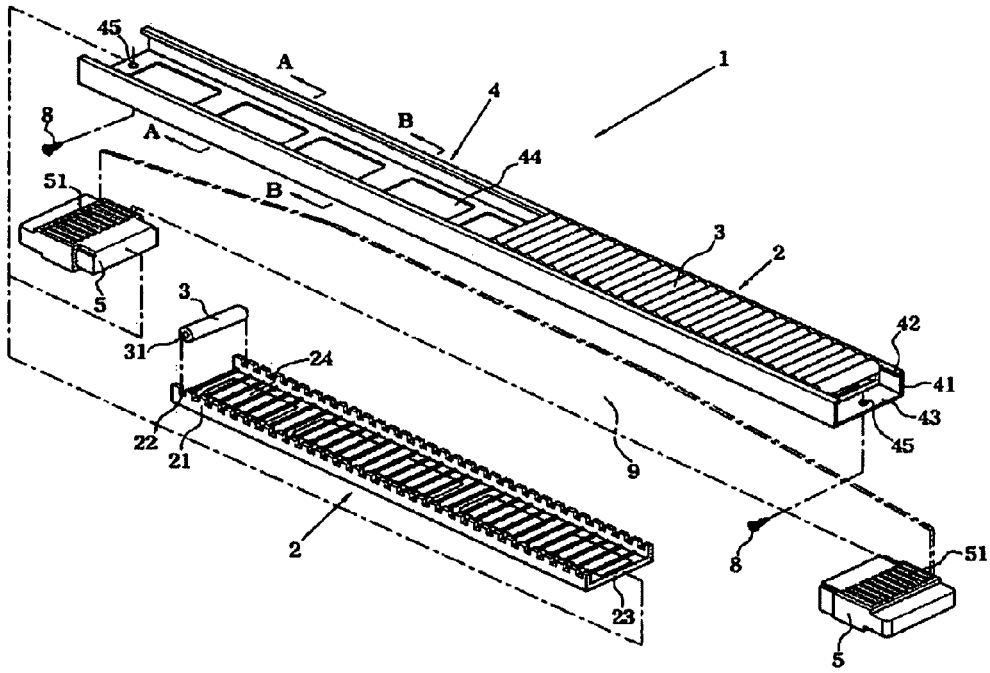
Fig. 11 PRIOR ART
FIG. 11 is an exploded perspective view showing a prior art shelf for a showcase.
Figure 12:
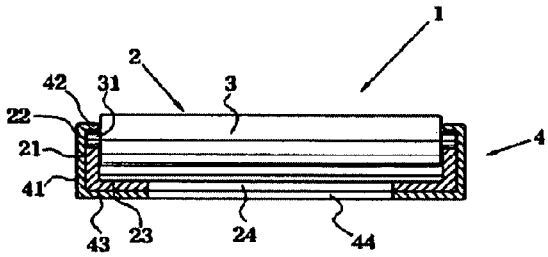
Fig. 12 PRIOR ART
FIG. 12 and FIG. 13 are cross-sectional views showing the prior art shelf of FIG. 11, which are taken along by line A-A and line B-B respectively.
Figure 13:
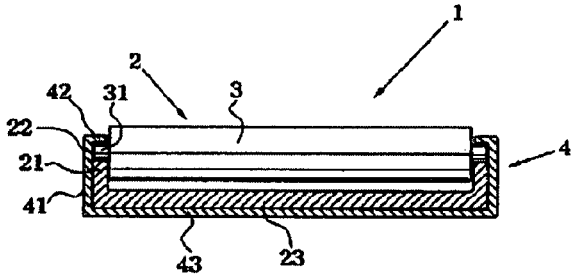
Fig. 13 PRIOR ART
Figure 14:
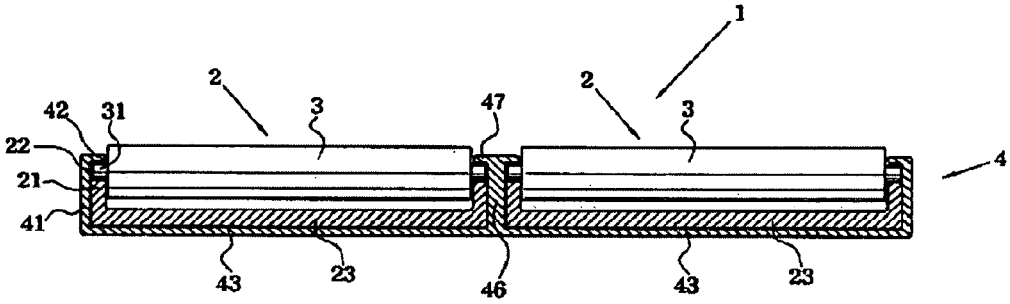
Fig. 14 PRIOR ART
FIG. 14 is a cross-sectional view showing the prior art shelf, in which roller units are aligned in two lines.
Figure 15:
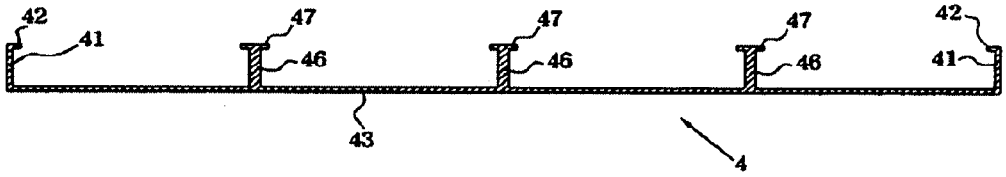
Fig. 15 PRIOR ART
FIG. 15 is an elevational cross-sectional view showing the shelf of FIG. 11.

Now, a shelf for a showcase according to the present invention will be described in more detail in the structure and operation thereof with reference to the accompanied drawings, wherein same component parts as shown in FIG. 11 are referred by the same reference numerals.

Figure 1:
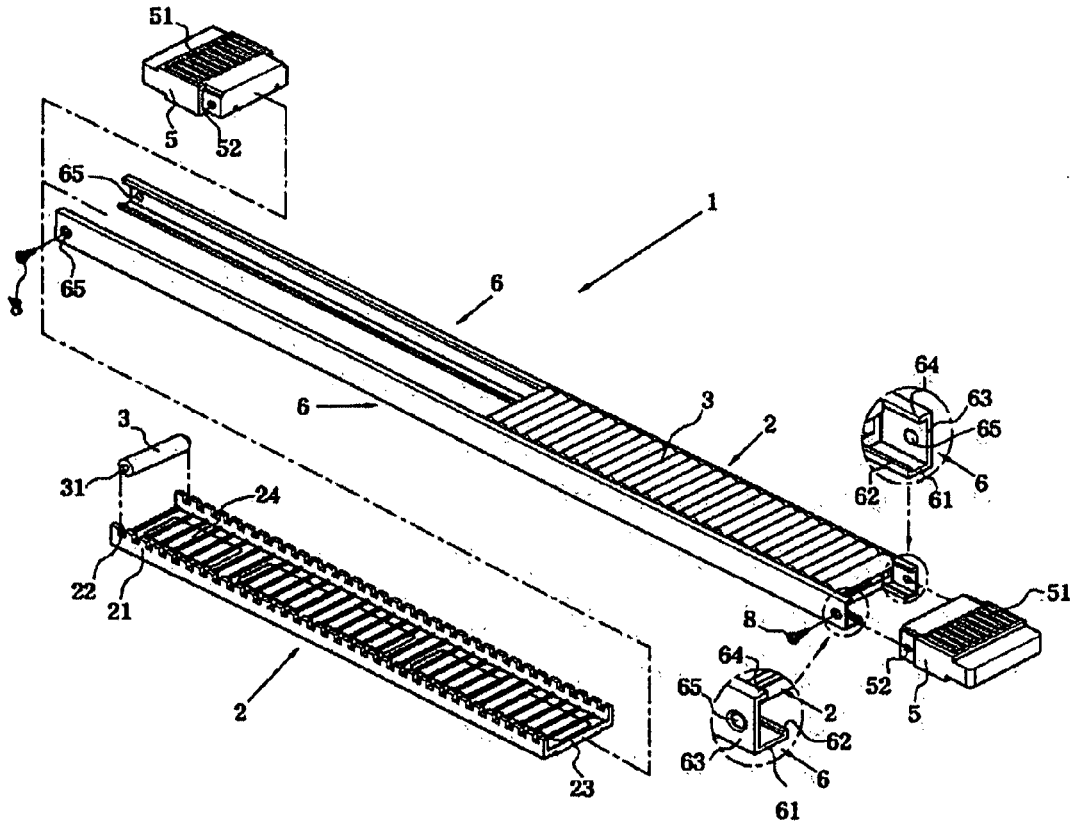
FIG. 1 is an exploded perspective view showing a shelf for a showcase according to a preferred embodiment of the present invention.

FIG. 1 is an exploded perspective view showing a shelf for a showcase according to a preferred embodiment of the present invention. Referring to FIG. 1, the shelf 1 is in the structure with a roller unit 2 having a plurality of rollers 3, and end caps 5 and fixing frames 6 coupled with each other. The roller unit 2 has an approximately U-shaped roller plate 23 formed with a plurality of fitting grooves 22 at both side walls 21 to be inserted by mounting shafts 31 protruded at both side ends of the rollers 3 in the same manner with the prior art structure. The end caps 5 are coupled with front and rear ends of the fixing frames 6 in the same manner with the prior art structure, except that the fixing frames, the principal parts of the shelf 1 for a showcase according to the present invention, are coupled with the roller unit 2 and close opening parts of the fitting grooves 22 for preventing deviation of the rollers 3. A guide element 9 may be added to be inserted into insertion grooves 51 of the end caps 5 to serve as a barrier as in the prior art structure as shown in FIG. 11.

Figure 2:
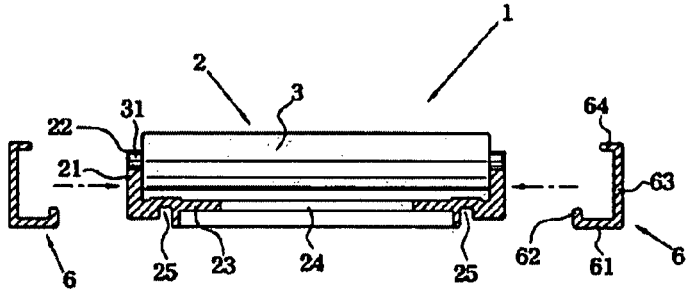
FIG. 2 and FIG. 3 are cross-sectional views showing assembling states of a shelf for a showcase of FIG. 1.
Figure 3:
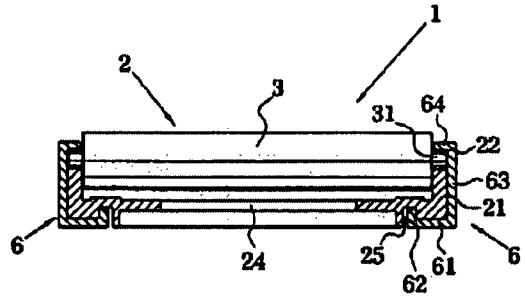

Referring to FIG. 1 showing the exploded perspective view of the shelf for a showcase and FIG. 2 and FIG. 3 respectively showing cross-sectional views of the shelf in the exploded and assembled states, the roller plate 23 of the roller unit 2 is formed with holding grooves 25 on both sides of a bottom surface. The fixing frames 6, the principal parts serving for fixing the roller unit 2 in the present invention, respectively include a bottom part 61 formed with a vertical rib 62 to be fitted into the holding groove 25 of the roller plate 23, and a vertical wall 63 surrounding an outside of the roller plate 23 and formed with a horizontal rib 64 closing opened parts of the fitting grooves 22 of the roller plate 23. The fixing frames 6 are mounted on both sides of the roller plate 23 of the roller unit 2 in pair correspondingly with each other. The fixing frames 6 have punched screw-coupling holes 65 at front and rear ends of the vertical wall 63. The end caps 5 have screw holes 52 formed at both side walls thereof. The screw-coupling holes 65 of the fixing frames 6 and the screw holes 52 of the end caps 5 are accorded with each other and coupled together by means of coupling screws 8.

The fixing frames 6 are in a single structure and mounted on both sides of the roller plate 23 of the roller unit 21 correspondingly. Therefore, the fixing frames 6 may be formed with aluminum materials by using a single mold by extrusion and used readily immediately after cutting the extrusion result by a predetermined length. Therefore, expenses in the molding and the raw materials may be reduced and assembling thereof may be conveniently realized immediately after two cutting steps.

Figure 4:
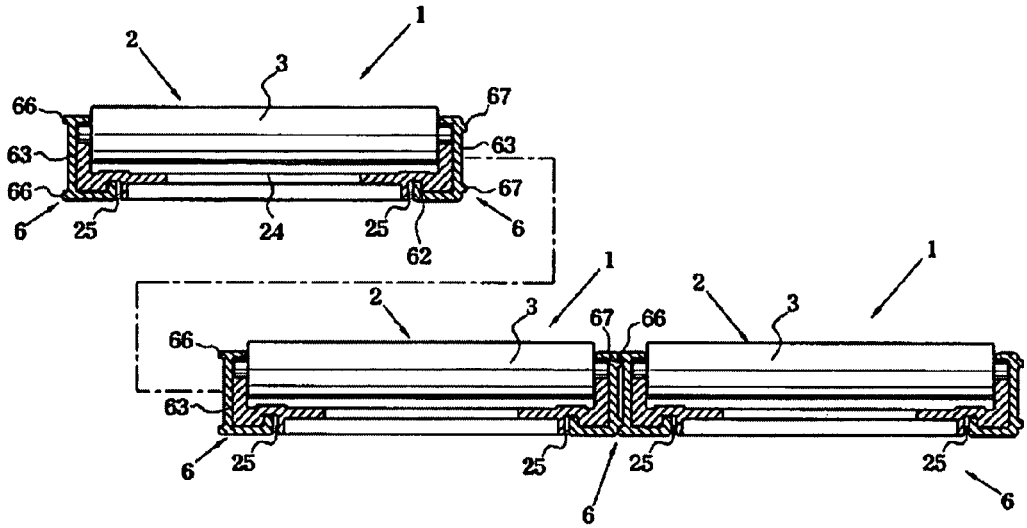
FIG. 4 is a cross-sectional view showing a shelf for a showcase according to another preferred embodiment of FIG. 1.

According to another preferred embodiment of the present invention as shown in FIG. 4, one of the fixing frames, which prevent deviation of the rollers 3 from the roller unit 2 and support the rollers 3, is formed with holding protrusions 66 protruded outward at upper and lower parts. The other fixing frame 6 is formed with fitting protrusions 67 at upper and lower parts correspondingly to the holding protrusions 66, so that the fitting protrusions 67 are inserted into the holding protrusions 66 and a plurality of such the shelves 1, of which assembling is finished, may be connected with each other in the above snap-fit between the holding protrusions 66 and the fitting protrusions 67 in the horizontal state.

Figure 5:
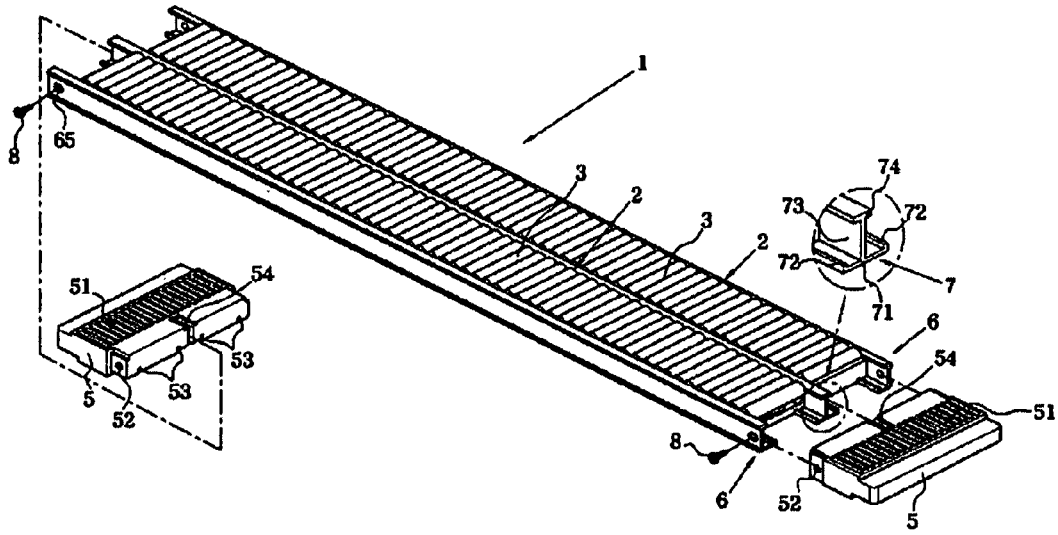
FIG. 5 and FIG. 6 are an exploded perspective view and an assembled cross-sectional view respectively showing a shelf for a showcase according to still another preferred embodiment of the present invention, in which roller units are coupled with each other in two lines.
Figure 6:
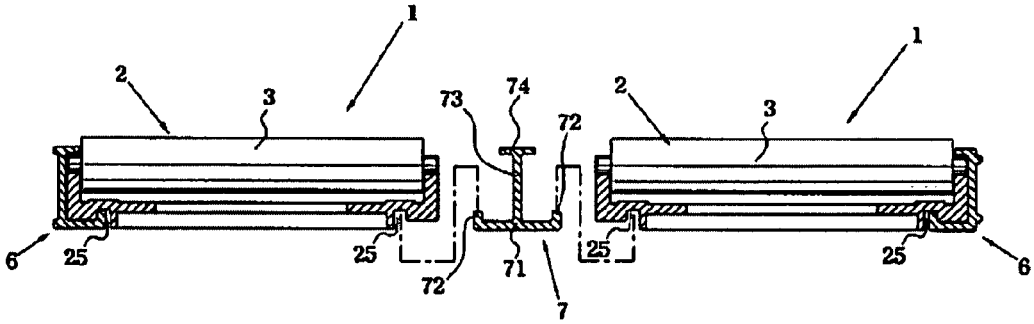

According to still another preferred embodiment of the present invention as shown in FIG. 5 and FIG. 6, an alternative embodiment of a fixing frame 6, which is referred to herein as a connection frame 7, includes a bottom part 71 formed with vertical ribs 72 on both sides to be fitted into the holding grooves 25 of first and second roller plates 23 of roller units 2, and a vertical wall 73 surrounding adjacent outsides of the first and second roller plates 23 and formed with a horizontal rib 74 closing opened parts of the fitting grooves 22 of the first and second roller plates 23.

Each of the end caps 5 is formed with holding grooves 53 and an inserting groove 54 respectively in the bottom surface part and a vertical part to be inserted by the front and rear ends of the connection frames 7. Therefore, two roller units 2 may be conveniently coupled with the fixing frames 6 and the single connection frame 7, providing a single shelf 1 having a wide sliding area increased by double or more.

Figure 7:
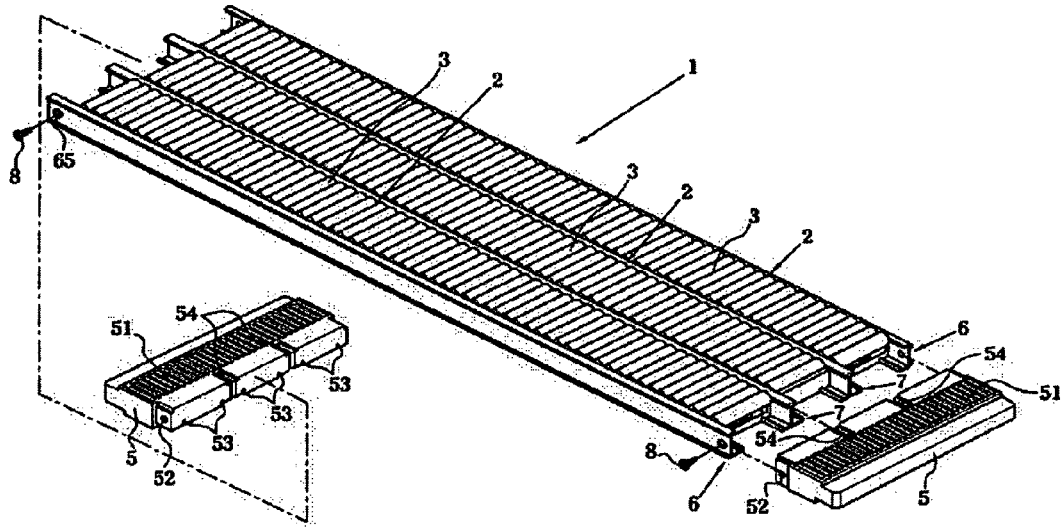
FIG. 7 and FIG. 8 are an exploded perspective view and an assembled cross-sectional view respectively showing a shelf for a showcase according to still another preferred embodiment of the present invention, in which roller units are coupled with each other in three lines.
Figure 8:
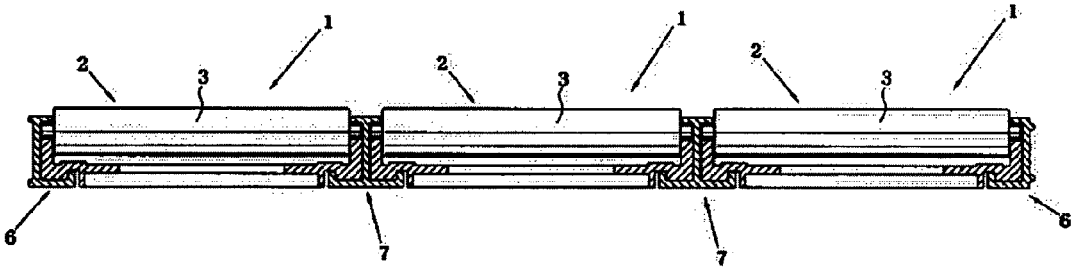

According to still another preferred embodiment of the present invention as shown in FIG. 7 and FIG. 8, three roller units 2 may be simply coupled with the fixing frames 6 respectively coupled on both sides of the roller units 2, and two connection frames 7, providing a single shelf 1 having a wide sliding area increased by three times.

Figure 9:
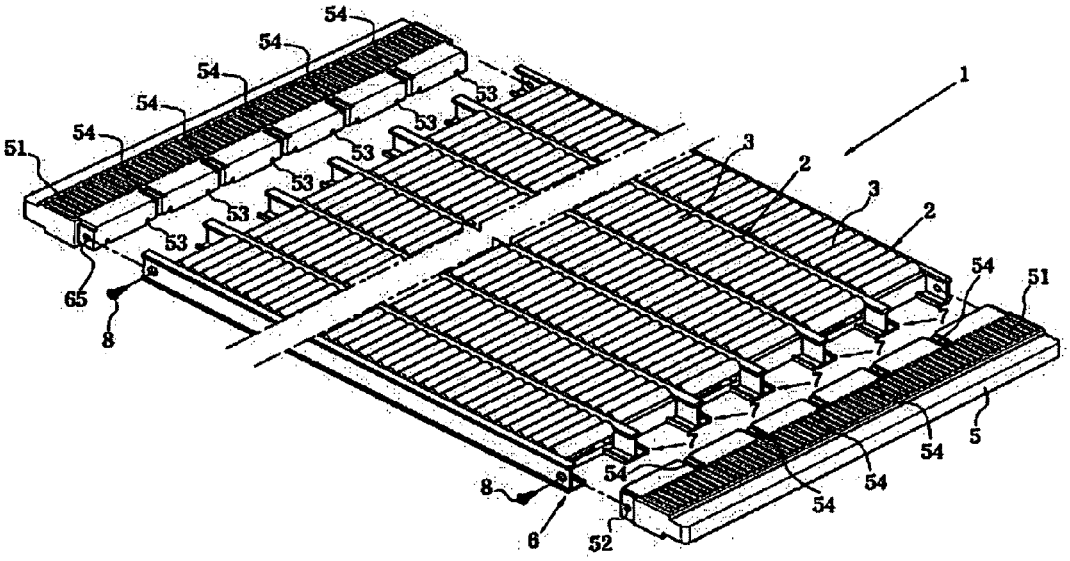
FIG. 9 and FIG. 10 are an exploded perspective view and an assembled cross-sectional view respectively showing a shelf for a showcase according to still another preferred embodiment of the present invention, in which roller units are coupled with each other in six lines.
Figure 10:
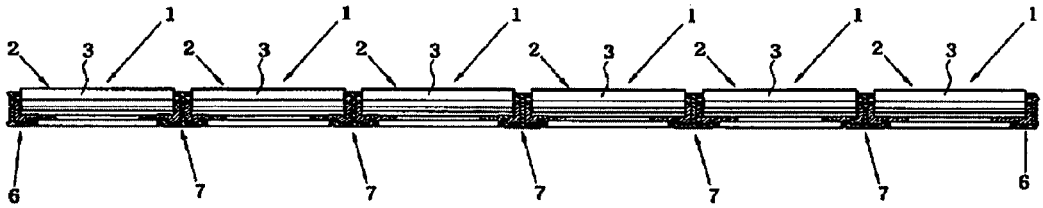

According to still another preferred embodiment of the present invention as shown in FIG. 9 and FIG. 10, six roller units 27 may be simply coupled with the fixing frames 6 respectively coupled on both sides of the roller units 2 and five connection frames 7, providing a single shelf 1 having a wide sliding area increased by six times.

The fixing frames 6 and the connection frames 7 may be controlled in the cutting lengths thereof while being kept in the same structures having no change in the shape when the sliding area of the shelf 1 has to be changed in size. However, in order to align a plurality of the roller units 2, the end caps 5 have to be formed with the holding grooves 53 and the fitting grooves 54 in the same quantity with that of the connection frames 7. Therefore, the connection frames 7 have to be formed individually to be added by a unit of 1, 2, 3, or 5 readily to obtain a desired sliding area.

As described hereinabove, according to the present invention, a single shelf 1 having a desired sliding area may be obtained by using the fixing frames 6 for coupling a single roller unit 2 and the connection frames 7 for aligning two, three, or six roller units 2 together in a simple structure. Therefore, the extrusion of the shelf becomes simplified, the assembling work becomes convenient by the snap-fitting, required raw materials become reduced, and the punching and finishing work for the chilled air ventilation holes may be omitted, so that the shelf may be provided at a low cost. Further, the component parts of the shelf may be simply exchanged with new ones in the case of damage during use.

Although the foregoing description has been made with reference to the preferred embodiments, these do not serve to restrict the present invention and it is to be understood that changes, modifications and equivalents of the present invention may be made by the ordinary skilled in the art without departing from the spirit and scope of the present invention and appended claims.

The invention claimed is:

1. A shelf for a showcase comprising:

a roller unit including a U-shaped roller plate having two opposing side walls and an adjoining bottom surface, the two side walls each having a plurality of fitting grooves, the bottom surface of the roller plate having two holding grooves;

a plurality of rollers having opposing side ends and a mounting shaft protruding from each side end of each roller, each mounting shaft being rotatably inserted into a fitting groove of the plurality of fitting grooves;

two fixing frames, a fixing frame of the two fixing frames being mounted on each side wall of the roller plate, each fixing frame including a bottom part formed with a vertical rib configured to fit into a holding groove of the two holding grooves, each fixing frame having a vertical wall configured to surround an outside of the roller plate, each fixing frame having a horizontal rib that closes an opening of each fitting groove of the plurality of fitting grooves to prevent deviation of the plurality of rollers after the plurality of rollers is fitted into the roller unit; and a first end cap fitted to a front end of each fixing frame: and a second end cap fitted to a rear end of each fixing frame.

2. The shelf as claimed in claim 1 wherein the vertical rib is a first vertical rib, wherein the bottom part of the fixing frame includes a second vertical rib formed on an opposite side of the vertical wall from the first vertical rib and configured to fit into a holding groove of a second roller plate, the horizontal rib being configured to close an opening of each fitting groove of a plurality of fitting grooves in the second roller plate.

3. The shelf as claimed in claim 2, further comprising between one and five additional roller units, each roller unit being coupled to at least one or more other roller unit using one or more fixing frames.

4. The shelf as claimed in claim 1, wherein the vertical wall of each fixing frame includes an upper part and a lower part, the upper and lower parts of the vertical walls each having a holding protrusion, the holding protrusions of each vertical wall being configured to be horizontally coupled to holding protrusions of another fixing frame.

5. The shelf as claimed in claim 4 wherein the vertical rib is a first vertical rib, wherein the bottom part of the fixing frame includes a second vertical rib formed on an opposite side of the vertical wall from the first vertical rib and configured to fit into a holding groove of a second roller plate, the horizontal rib being configured to close an opening of each fitting groove of a plurality of fitting grooves in the second roller plate.

6. The shelf as claimed in claim 5, further comprising between one and five additional roller units, each roller unit being coupled to at least one or more other roller unit using one or more fixing frames.

* * * * *

UNITED STATES PATENT AND TRADEMARK OFFICE

CERTIFICATE OF CORRECTION

PATENT NO. : 8,276,772 B2
APPLICATION NO. : 12/593961
DATED : October 2, 2012
INVENTOR(S) : Deok Rae Kim It is certified that error appears in the above-identified patent and that said Letters Patent is hereby corrected as shown below:

Title Page, Item 73

Please change the Assignee information from "Seidai Industrial Co., Ltd., Goyang-si (KR)" to read "Seidae Industrial Co., Ltd., Goyang-si (KR)."

Signed and Sealed this
Fourteenth Day of May, 2013

Teresa Stanek Rea
*Acting Director of the United States Patent and Trademark Office*